United States Patent [19]

Isobe et al.

[11] Patent Number: 4,690,117

[45] Date of Patent: Sep. 1, 1987

[54] FUEL INJECTION CONTROL DEVICE FOR INTERNAL COMBUSTION ENGINE

[75] Inventors: Toshiaki Isobe, Nagoya; Hidehiro Oba, Aichi, both of Japan

[73] Assignee: Toyota Jidosha Kabushiki Kaisha, Toyota, Japan

[21] Appl. No.: 897,940

[22] Filed: Aug. 19, 1986

[30] Foreign Application Priority Data

Sep. 3, 1985 [JP] Japan ..... 60-194377

[51] Int. Cl.[4] ..... F02M 51/00

[52] U.S. Cl. ..... 123/492; 123/493; 123/494

[58] Field of Search ..... 123/478, 492, 493, 494

[56] References Cited

U.S. PATENT DOCUMENTS

| | | | |
|---|---|---|---|
| 4,436,074 | 3/1984 | Nakatsuka et al. | 123/494 X |
| 4,492,211 | 1/1985 | Shimomura et al. | 123/494 X |
| 4,548,181 | 10/1985 | Ishikawa et al. | 123/492 |
| 4,616,621 | 10/1986 | Kuroiwa et al. | 123/494 X |

FOREIGN PATENT DOCUMENTS

| | | | |
|---|---|---|---|
| 0013428 | 7/1976 | Japan . | |
| 0032919 | 3/1980 | Japan . | |
| 0151134 | 11/1980 | Japan . | |
| 0015740 | 1/1983 | Japan | 123/494 |
| 0174129 | 10/1983 | Japan . | |
| 0126038 | 7/1984 | Japan | 123/494 |
| 0010171 | 3/1985 | Japan . | |

*Primary Examiner*—Willis R. Wolfe, Jr.

*Attorney, Agent, or Firm*—Cushman, Darby & Cushman

[57] ABSTRACT

A fuel injection control device for an internal combustion engine in which a fundamental fuel injection amount is set according to suction air amount per one revolution of the engine Q/N. The fuel injection control device includes a transitional operation start timing detector for detecting an acceleration start timing or a deceleration start timing, an engine rotational number measurer for measuring a predetermined number of rotations of the engine from the acceleration start timing or the deceleration start timing, a throttle valve angle detector for detecting that a throttle valve angle is out of a set range, and apparatus for setting an upper limit value and/or a lower limit value of Q/N when the throttle valve angle detector generates a signal showing that the throttle valve angle is out of the set range until the engine rotational number measurer measures the predetermined number of rotations of the engine.

6 Claims, 6 Drawing Figures

FUEL INJECTION CONTROL DEVICE FOR INTERNAL COMBUSTION ENGINE .

BACKGROUND OF THE INVENTION

1. Technical Field

The present invention relates to a fuel injection control device which corrects a suction air amount signal erroneously measured in association with pulsation of suction air during acceleration or deceleration of an engine.

2. Description of the Prior Art

A Karman's vortex type flow meter is known as a means for measuring fluid flow (Japanese Patent Publication No. 51-13428). The Karman's vortex type flow meter has relatively many advantages in that the flow measuring response to a change in flow is good and the fluid resistance in a passage is small as compared with a vane type flow meter.

In an internal combustion engine having a Karman's vortex type flow meter in a suction passage, the number of Karman's vortices generated in proportion to the amount of suction air is detected by ultrasonic modulation, and the amount of fuel to be injected from a fuel injector is computed according to a measured value of suction air amount as measured by the number of Karman's vortices Japanese Patent Publication No. 60-10171).

Concretely, a columnar Karman's vortex generating device is provided in the suction passage to drive a pulse generator for generating a fixed pulse according to Karman's vortex generated downstream of the device, thereby supplying fuel in the amount proportional to an output frequency of the pulse generator.

A hot-wire type flow meter is known as another type of suction air amount measuring means. In engines employing a hot-wire type flow meter, a predetermined current flows in a platinum hot wire, for example, provided in the suction passage, and the amount of suction air is measured according to the amount of change in resistance of the platinum hot wire cooled by the suction air passing through the hot wire. Then, the amount of fuel as determined according to the measured amount of the suction air is supplied to the engine.

The Karman's vortex type flow meter and the hot wire type flow meter as mentioned above are provided in the suction passage which is regarded as a substantially mere cylinder.

As is mentioned above, the suction passage including the conventional Karman's vortex type flow meter or hot-wire type flow meter is formed cylindrically. Therefore, in an internal combustion engine having such suction air amount measuring means in the cylindrical suction passage, measurement of the amount of suction air is apt to be influenced by pulsation of the suction air, particularly just after rapid closing or rapid opening of a throttle valve at rapid deceleration or rapid acceleration when the suction air pulsates largely. As a result, a frequent problem is that the amount of suction air to be detected by the aforementioned flow meters is not properly measured during a transitional operation.

As a result, an error is apt to be created in the amount of fuel to be injected as computed according to the suction air amount signal during the transitional operation to cause over-richness or over-leanness of fuel.

SUMMARY OF THE INVENTION

It is therefore an object of the present invention to provide for internal combustion engines a fuel injection control device which overcomes the aforementioned problem of the prior art.

Another object of the present invention is to provide such a fuel injection control device which can correct disturbance of the suction air amount signal caused by pulsation of suction air just after rapid opening or rapid closing of the throttle valve at acceleration or deceleration to thereby prevent over-richness or over-leanness of fuel during the transitional operation.

In accordance with an aspect of the present invention, there is provided, as shown in FIG. 1, a fuel injection control device for internal combustion engine including suction air amount measuring means for measuring suction air amount Q, engine rotational speed detection means for detecting the number of rotations N of the engine per fixed time, and fuel injection amount setting means for setting a fundamental fuel injection amount according to a suction air amount signal generated by said suction air amount measuring means and an engine rotational speed signal generated by said engine rotational speed detection means; said fuel injection control device comprising: transitional operation start timing detection means for detecting an acceleration start timing or a deceleration start timing of the engine; engine rotational number measuring means for measuring a predetermined number of rotations of the engine from the acceleration start timing or the deceleration start timing; throttle valve angle detection means for detecting that a throttle valve angle is out of a set range; and means for setting an upper limit value and/or a lower limit value of Q/N calculated from said suction air amount signal and said engine rotational speed signal when said throttle valve angle detection means generates a signal showing that the throttle valve angle is out of said set range until said engine rotational number measuring means measures said predetermined number of rotations of the engine.

The suction air amount measuring means may comprise a Karman's vortex type flow meter or a hotwire type flow meter.

In accordance with another aspect of the present invention, time measuring means for measuring a predetermined elapsed time from the acceleration start timing or the deceleration start timing may substituted for the engine rotational number measuring means.

According to the present invention, the fundamental amount of fuel to be injected is computed according to the suction air amount Q measured by the suction air amount measuring means and number of rotations N of the engine per fixed time detected by the engine rotational speed detection means. When the acceleration start timing is detected by the acceleration start timing detection means, a period of time from the acceleration start timing during which the pulsation of suction air is great is measured by the engine rotational number measuring means or the time measuring means, and during this period of time, it is detected whether or not the throttle valve angle is out of the predetermined set range by the throttle valve angle detection means.

While the throttle valve angle detection means is generating the signal showing that the throttle valve angle is out of the set range, the upper limit value and/or the lower limit value of Q/N calculated according to the suction air amount signal and the engine rotational speed signal are set.

Similarly, when the deceleration start timing is detected by the deceleration start timing detection means, the fundamental amount of fuel to be injected is computed according to the suction air amount Q measured by the suction air amount measuring means and number of rotations N of the engine per fixed time detected by the rotational speed detection means. At this time, a period of time from the deceleration start timing during which the pulsation of suction air is great is measured by the engine rotational number measuring means or the time measuring means, and during this period of time, it is detected whether or not the throttle valve angle is out of the predetermined set range by the throttle valve angle detection means. While the throttle valve angle detection means is generating the signal showing that the throttle valve angle is out of the set range, the upper limit value and/or the lower limit value of Q/N calculated according to the suction air amount signal and the engine rotational speed signal are set.

As is mentioned above, according to the present invention, the upper limit value and/or the lower limit value are set for the suction air amount signal erroneously measured as is different from a proper suction air amount signal while a large pulsation of suction air may occur just after rapid closing or rapid opening of the throttle valve. Accordingly, the amount of fuel to be injected may be calculated according to the suction air amount as corrected by the upper limit value and/or the lower limit value, and thereby over-richness or over-leanness of fuel during the transitional operation may be securely prevented.

The above and other objects, features and advantages of the present invention and the manner of attaining them will become more clearly apparent, and the invention itself will best be understood, from the following description of a preferred embodiment taken in connection with the accompanying drawings.

PREFERRED EMBODIMENT OF THE INVENTION

There will be now described a preferred embodiment of the present invention with reference to the drawings.

Figure 1:
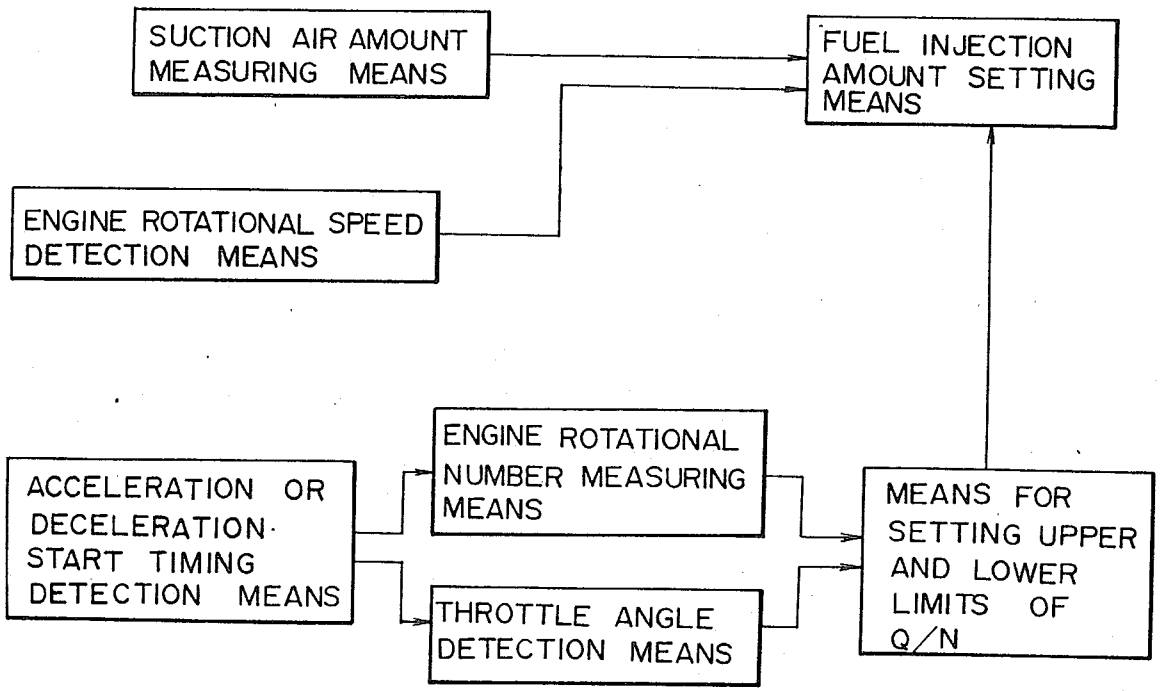
FIG. 1 is a schematic diagram showing a fundamental arrangement of the present invention.
Figure 2:
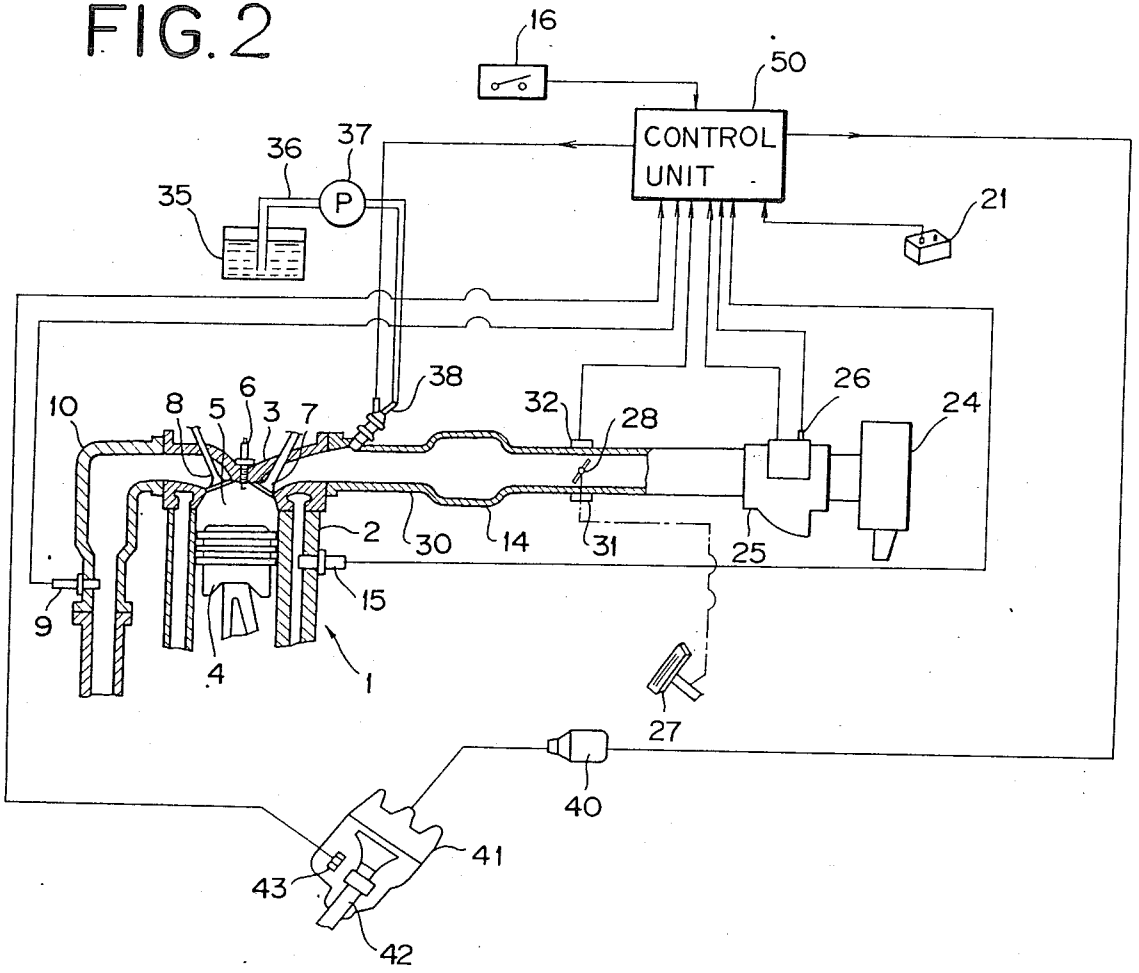
FIG. 2 is a schematic view showing a preferred embodiment of the internal combustion engine employing the fuel injection control device of the present invention.

FIG. 2 shows an exemplary schematic arrangement of an internal combustion engine employing a fuel injection control device according to the present invention.

There are shown in FIG. 2 an internal combustion engine body 1, cylinder block 2, cylinder head 3, piston 4, combustion chamber 5, ignition plug 6, suction valve 7, exhaust valve 8, oxygen sensor 9 for detecting a concentration of oxygen in an exhaust gas in an exhaust manifold 10, coolant temperature sensor 15 for measuring a coolant temperature, ignition switch 16 and battery power supply 21.

A suction system is designed in such a manner that an amount of suction air inducted from an air cleaner 24 is measured by a Karman's vortex type flow meter 25, temperature of the suction air is measured by a suction air temperature sensor 26, and a predetermined amount of the suction air is supplied through a throttle valve 28 adapted to be opened and closed according to an amount of depression of an accelerator pedal 27 to an intake manifold 30. The throttle valve 28 is installed in a throttle body 31, which is provided with a throttle sensor 33 for detecting an opening angle of the throttle valve 28 and an idle switch 32 for detecting a full closed position of the throttle valve 28. Further, there is provided in the vicinity of the suction valve 7 in the intake manifold 30 a fuel injector 38 for injecting a predetermined amount of fuel to be fed under pressure from a fuel tank 35 through a passage 36 by a fuel pump 35.

An ignition system is designed in such a manner that a high voltage generated by an ignition coil 40 is supplied to a distributor 41, which acts to control a predetermined ignition timing and simultaneously distribute the high voltage to the ignition plug 6 of each cylinder at a predetermined timing. The distributor 41 is provided with a rotational speed sensor 43 for detecting a rotational angle and a rotational speed of the engine from a rotational position of a distributor shaft 42 synchronously rotating with a crank shaft (not shown). In a preferred embodiment, the rotational speed sensor 43 is designed to generate twenty four pulse signals every two rotations of the crank shaft and generate one pulse signal at a predetermined angle every one rotation of the crank shaft.

Figure 3:
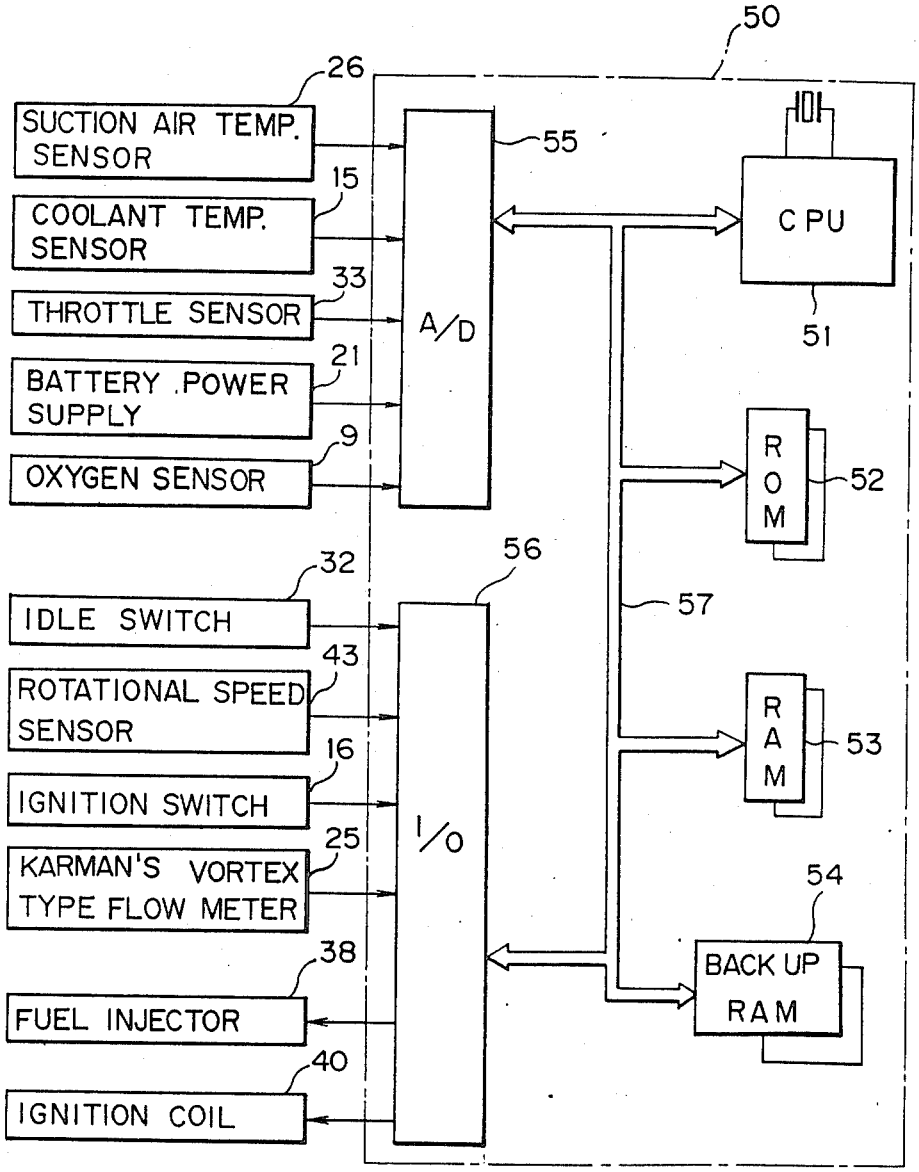
FIG. 3 is a block diagram showing a preferred embodiment of a fuel injection control device of the present invention.

A control unit 50 may be a microcomputer adapted to be operated by the battery power supply 21. As shown in FIG. 3, the microcomputer incorporates a central processing unit (CPU) 51, read-only memory (ROM) 52, random access memory (RAM) 53 and backup random access memory (RAM) 54 for retaining a memory during an off state of the ignition switch 16. The ROM 52 stores programs such as a main routine, fuel injection amount control routine and ignition timing control routine, and various fixed data, constants, etc. as required for processing the programs. The microcomputer further incorporates an A/D converter 55 having a multiplexer and an I/O device 56 having a buffer memory. Both the devices 55 and 56 are connected with the devices 51 to 54 by means of a common bus 57.

The A/D converter 55 is adapted to receive output signals from the throttle sensor 33 for detecting a throttle valve angle, the suction air temperature sensor 26, etc. through a buffer into the multiplexer therein, and converts these analog data to digital ones. Then, output signals from the A/D converter 55 are applied to the CPU 51 and the RAM 53 or 54 at a predetermined timing in accordance with a command of the CPU 51. Thus, fresh detected data of suction air amount, suction air temperature and coolant temperature, etc. are read in the RAM 53, and these data are stored at a predetermined area of the RAM 53. On the other hand, the I/O device 56 is adapted to receive detection signals from each of the idle switch 32 for detecting a full closed throttle valve position, the rotational speed sensor 43, the Karman's vortex type flow meter 25, etc., and apply these data to the CPU 51 and the RAM 53 or 54 at a predetermined timing in accordance with a command of the CPU 51. As to Karman's vortex type flow meter 25, a rising edge or a falling edge of a Karman's vortex pulse signal from the Karman's vortex type flow meter 25 is detected to measure a pulse period and thereby calculate the amount of suction air.

The CPU 51 acts to calculate an amount of fuel to be injected on the basis of the data as detected by each of the sensors according to the program stored in the ROM 52, and apply a pulse signal based on the calculation through the I/O device 56 to the fuel injector 38. That is to say, fundamentally, a fundamental fuel amount is calculated according to the suction air amount measured by the Karman's vortex type flow meter 25 and the engine rotational speed detected by the rotational speed sensor 43, and is corrected according to the suction air temperature and the coolant temperature as detected. Then, a pulse signal corresponding to the corrected fuel amount is supplied from a driving circuit (not shown) in the I/O device 56 to the fuel injector 38.

Figure 4:
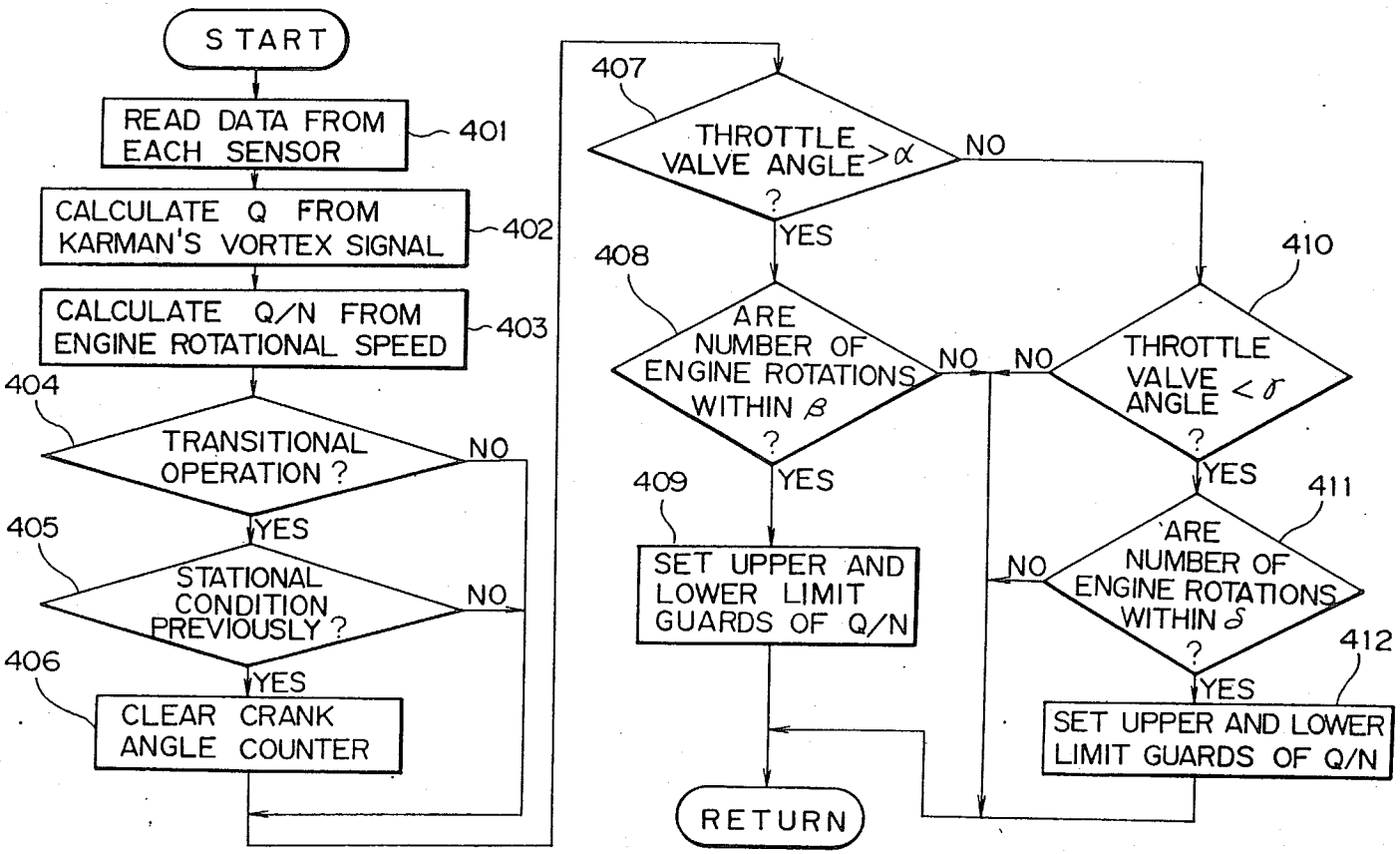
FIG. 4 is a flow chart showing a main routine in the preferred embodiment of the present invention.
Figure 5:
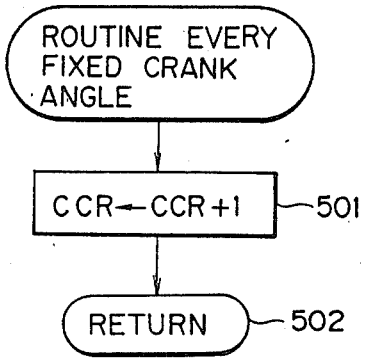
FIG. 5 is a flow chart showing an interruption routine used in the routine shown in FIG. 4.

There will be next described one example of fuel injection control by the control unit 50 according to the present invention as taken with reference to a flow chart shown in FIGS. 4 and 5.

FIG. 4 shows a main routine of fuel injection amount control. In this main routine, data detected by the Karman's vortex type flow meter 25, the rotational speed sensor 43, the suction air temperature sensor 26, the coolant temperature sensor 15 and the throttle sensor 32 are read at the first step 401, and these data are written in the RAM 53.

In the next step 402, a suction air amount Q is calculated according to a signal detected by the Karman's vortex type flow meter 25, and in the next step 403, operation of Q/N is carried out by using the suction air amount Q and number of rotations N of the engine per fixed time detected by the rotational speed sensor 43. A fundamental fuel injection amount TP is represented by $Q/N \times k$, where k is a constant to be determined by a capacity of the fuel injector 38 and a set air-fuel ratio.

Then, in steps 404 and 405, an acceleration start timing or deceleration start timing as a transitional operation start timing is detected. In the step 404, a transitional state is decided when an absolute value $|\Delta TA|$ of a change in throttle valve angle per a fixed time by the throttle sensor 32 becomes a set value or more, for example. When the transitional state is decided in the step 404, it is decided in the next step 405 whether or not the engine is under a stationary condition previously, that is, the absolute value $|\Delta TA|$ is less than the set value. If it is decided that $|\Delta TA|$ is less than the set value in the step 405, the acceleration or deceleration start timing is decided, and the routine proceeds to step 406, where a crank angle counter is cleared.

When the crank angle counter is cleared, step 501 goes to step 502 in accordance with a routine at every fixed crank angle as shown in FIG. 5, and in this routine, crank angle counter is incremented every fixed crank angle 30° CA. Thus, the number of engine rotations is measured from the acceleration start timing or deceleration start timing.

The routine at every fixed crank angle shown in FIG. 5 is used as an interruption routine at steps 407 to 412 in FIG. 4.

In the step 407, it is decided whether or not the throttle valve angle TA is greater than a predetermined value $\alpha$ (60°, for example). If $TA > \alpha$ is decided, the routine proceeds to the step 408. In the step 408, it is decided whether or not the number of engine rotations after start of acceleration is within $\beta$ rotations. If the number of engine rotations after start of acceleration is within the $\beta$ rotations, the step 408 goes to the step 409.

In the step 409, upper and lower limit guards are set for the suction air amount Q/N per one rotation of the engine as calculated in the step 403.

Figure 6:
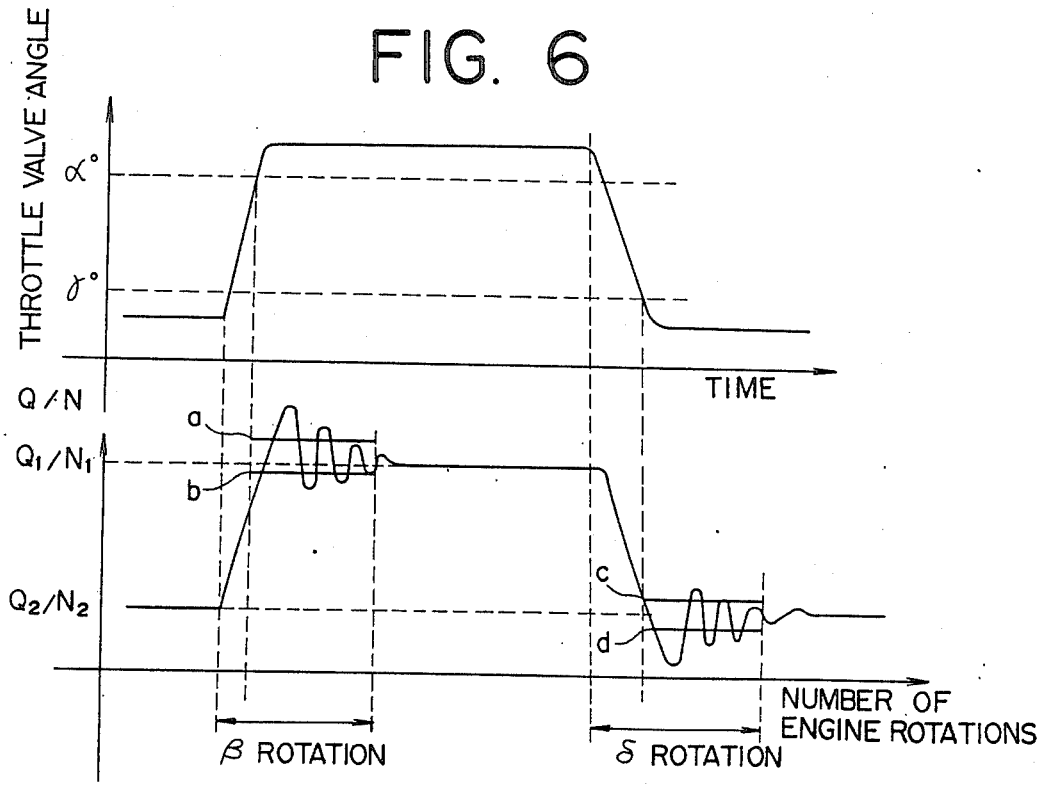
FIG. 6 is a graph showing a corrected Q/N value in the preferred embodiment of the present invention.

In other words, as shown in FIG. 6, an upper limit value (a) and a lower limit value (b) are set for the value of Q/N for calculation of the fundamental fuel injection amount. When the throttle valve angle TA is rapidly increased from 5° (nearly full closed position) to 80° (full open position), for example, the suction air amount per one rotation of the engine Q/N rises rapidly to increase fluctuation in the value of Q/N for some time after rapid opening of the throttle valve. In this case, each guard of the upper limit value (a) and the lower limit value (b) is set for the value of Q/N. This guard continues to operate until the engine rotational speed comes to the $\beta$ rotations detected by the crank angle counter after start of acceleration.

If the throttle valve angle $TA \leqq \alpha$ is decided in the step 407, the routine proceeds to the step 410, where it is decided whether or not the throttle valve angle TA is less than a predetermined value $\gamma$ (5°, for example). If $TA > \gamma$ is decided, the routine is ended. If $TA < \gamma$ is decided in the step 410, the routine proceeds to the step 411, where it is decided whether or not the number of engine rotations after start of deceleration is within 6 rotations. If the number of engine rotations exceeds the 6 rotations, the routine is ended.

If the number of engine rotations is in the range of the $\delta$ rotations, the routine proceeds to the step 412, where upper and lower limit guards are set for the value of Q/N. That is to say, until the number of engine rotations after start of deceleration reaches the rotations, an upper limit value (c) and a lower limit value (d) are set to the value of Q/N. When the number of engine rotations after start of deceleration exceeds the predetermined value 6, the upper and lower limit guards of the Q/N are removed until the next transitional state.

In this manner, the value of Q/N is provided with the upper and lower limit guards until the number of engine rotations after start of acceleration or deceleration reaches the predetermined value, so as to avoid over-richness or over-leanness of fuel accompanied by pulsation of suction air.

Although in the aforementioned preferred embodiment, the transitional operation is decided according to an absolute value of a change in throttle valve angle per a fixed time, the present invention is not limited to the embodiment, but the transitional operation may be decided according to a difference in throttle valve angle $TA_n - TA_{n-1}$ as calculated every fixed crank angle. Further, only in case of acceleration, a change from ON to OFF of the idle switch 32 can be adopted.

In the preferred embodiment, there is given the following relation among the upper limit value (a), the lower limit value (b) and a value of $Q_1/N_1$ according to a throttle valve angle under a stationary condition just before acceleration.

$$a - Q_1/N_1 > Q_1/N_1 - b$$

Further, there is also given the following relation among the upper limit value (c), the lower limit value (d) and a value of $Q_2/N_2$ according to a throttle valve angle under the stationary condition just before deceleration.

$$C-Q_2/N_2<Q_2/N_2-d$$

Although the upper and lower limits of the Q/N is specified by the number of engine rotations $\beta$ and $\gamma$ in this embodiment, they may be specified by a time as measured by a timer in substitution for the number of engine rotations.

In an engine employing a suction air amount measuring means regarded as a substantially mere cylinder such as a Karman's vortex type flow meter or a hot-wire type flow meter provided in a suction passage, pulsation of suction air generally tends to have a great influence upon a signal of Q/N. If the present invention is applied to the engine having such a suction air amount flow meter liable to be influenced by pulsation of suction air, a fuel injection amount is calculated according to the Q/N value corrected by setting the upper and lower limit values as mentioned above under the transitional condition such as acceleration or deceleration, and a proper amount of fuel may be supplied to the engine according to the transitional condition at that time.

According to the present invention, since an upper limit guard and/or a lower limit guard is set for a suction air amount signal measured by a suction air amount detecting means just after rapid opening and closing of the throttle valve at acceleration and deceleration, a measured value of the suction air amount as influenced by pulsation of suction air at the transitional operation is corrected to thereby supply a proper amount of fuel to be injected to the engine according to the corrected suction air amount signal.

Accordingly, it is possible to avoid overrichness and over-leanness liable to be generated under a transitional condition such as acceleration or deceleration. In addition, quick response of the engine at acceleration may be improved, and engine stall may be securely prevented at deceleration to thereby improve drivability.

While the invention has been described and shown with particular reference to the preferred embodiment, it will be apparent that variations might be possible that would fall within the scope of the present invention which is not intended to be limited except as defined in the following claims.

What is claimed is:

1. A fuel injection control device for internal combustion engine including suction air amount measuring means for measuring suction air amount Q, engine rotational speed detection means for detecting a number of rotations N of the engine per fixed time, and fuel injection amount setting means for setting a fundamental fuel injection amount according to a suction air amount signal generated by said suction air amount measuring means and an engine rotational speed signal generated by said engine rotational speed detection means; said fuel injection control device comprising:

transitional operation start timing detection means for detecting an acceleration start timing or a deceleration start timing of the engine;

engine rotational number measuring means for measuring a predetermined number of rotations of the engine from the acceleration start timing or the deceleration start timing;

throttle valve angle detection means for detecting that a throttle valve angle is out of a set range; and means for setting an upper limit value and/or a lower limit value of Q/N calculated from said suction air amount signal and said engine rotational speed signal when said throttle valve angle detection means generates a signal showing that the throttle valve angle is out of said set range until said engine rotational number measuring means measures said predetermined number of rotations of the engine.

2. The fuel injection control device according to claim 1 wherein said suction air amount measuring means is a Karman's voltex type flow meter.

3. The fuel injection control device according to claim 1 wherein said suction air amount measuring means is a hot-wire type flow meter.

4. A fuel injection control device for internal combustion engine including suction air amount measuring means for measuring suction air amount Q, engine rotational speed detection means for detecting a number of rotations N of the engine per fixed time, and fuel injection amount setting means for setting a fundamental fuel injection amount according to a suction air amount signal generated by said suction air amount measuring means and an engine rotational speed signal generated by said engine rotational speed detection means; said fuel injection control device comprising:

transitional operation start timing detection means for detecting an acceleration start timing or a deceleration start timing of the the engine;

time measuring means for measuring a predetermined elapsed time from the acceleration start timing or the deceleration start timing;

throttle valve angle detection means for detecting that a throttle valve angle is out of a set range; and means for setting an upper limit value and/or a lower limit value of Q/N calculated from said suction air amount signal and said engine rotational speed signal when said throttle valve angle detection means generates a signal showing that the throttle valve angle is out of said set range until said time measuring means measures said predetermined time.

5. The fuel injection control device according to claim 4 wherein said suction air amount measuring means is a Karman's vortex type flow meter.

6. The fuel injection control device according to claim 4 wherein said suction air amount measuring means is a hot-wire type flow meter.

* * * * *